US006877491B2

(12) United States Patent
Hanawa et al.

(10) Patent No.: US 6,877,491 B2
(45) Date of Patent: Apr. 12, 2005

(54) AIR FUEL INJECTION ENGINE

(75) Inventors: Kaoru Hanawa, Saitama (JP); Shuichi Ishida, Saitama (JP); Hiroya Ueda, Saitama (JP); Hiroshi Kuribara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/606,357

(22) Filed: Jun. 26, 2003

(65) Prior Publication Data

US 2004/0065295 A1 Apr. 8, 2004

(30) Foreign Application Priority Data

Jul. 31, 2002 (JP) ..... 2002-223716
Jul. 31, 2002 (JP) ..... 2002-223717

(51) Int. Cl.[7] ..... F02M 23/00
(52) U.S. Cl. ..... 123/533; 123/470; 123/195 C
(58) Field of Search ..... 123/531, 534, 123/468–470, 305, 195 C

(56) References Cited

U.S. PATENT DOCUMENTS 4,958,537 A * 9/1990 Diehl et al. ..... 123/195 C
5,123,399 A * 6/1992 Motoyama et al. ..... 123/469
5,233,952 A 8/1993 Isaka ..... 123/533
5,465,699 A * 11/1995 Voigt ..... 123/470
5,499,612 A * 3/1996 Haughney et al. ..... 123/470
5,551,400 A * 9/1996 Rice et al. ..... 123/470
5,657,733 A * 8/1997 Dozier et al. ..... 123/470
5,699,770 A * 12/1997 Matsumoto et al. ..... 123/470
5,765,534 A * 6/1998 Brown et al. ..... 123/470
5,896,837 A 4/1999 Nysten et al. ..... 123/468
6,012,418 A * 1/2000 Bodenhausen et al. ..... 123/470

FOREIGN PATENT DOCUMENTS

| | | |
|---|---|---|
| DE | 39 20 089 A1 | 1/1991 |
| DE | 199 15 792 A1 | 10/2000 |
| EP | 0 666 410 A1 | 8/1995 |
| JP | 2001-1140729 | 5/2001 |

* cited by examiner

*Primary Examiner*—Erick Solis
(74) *Attorney, Agent, or Firm*—Birch, Stewart, Kolasch & Birch, LLP

(57) ABSTRACT

An air fuel injection engine including an injector composed of a fuel injection valve for injecting fuel and an air fuel injection valve for directly injecting fuel together with compressed air into a combustion chamber and an injector housing for holding and securing the injector to an engine body. The injector is supported on a head cover, and at least part of a compressed air supply passage for supplying compressed air to the injector is provided directly in the head cover. Further, an injector housing is formed integrally with a head cover which forms part of an engine body. With this configuration, the scale of the engine, the complication of the structure around the engine, and the number of part required can be kept to a minimum.

20 Claims, 8 Drawing Sheets

AIR FUEL INJECTION ENGINE

CROSS-REFERENCE TO RELATED APPLICATION

The present application claims priority under 35 U.S.C. §119 to Japanese Patent Application No. 2002-223716 and Application No. 2002-223717 filed Jul. 31, 2002, the entire contents of which are hereby incorporated by reference.

BACKGROUND OF THE INVENTION

1. Field of the Invention

This invention relates to an air fuel injection engine which includes an injector composed of a fuel injection valve for injecting fuel and an air fuel injection valve for directly injecting fuel into a combustion chamber and an injector housing for holding and securing the injector to an engine body.

2. Description of Background Art

Conventionally, an engine of the type described is already known from the official gazette of Japanese Patent No. 2,820,782 and so forth.

However, the conventional engine mentioned above has a structure wherein the injector housing is secured to a cylinder head, and there is the possibility that increase of the number of parts, increase in scale of the engine and complication of the structure around the engine may be invited.

SUMMARY AND OBJECTS OF THE INVENTION

The present invention has been made in view of such a circumstance as described above, and it is an object of the present invention to provide an air fuel injection engine wherein the scale of the engine and complication of the structure around the engine can be minimized and the number of parts can be reduced.

In order to attain the object described above, according to a first aspect of the invention, an air fuel injection engine is provided with an injector composed of a fuel injection valve for injecting fuel and an air fuel injection valve for directly injecting fuel together with compressed air into a combustion chamber. An injector housing for holding and securing the injector to an engine body is formed integrally with a head cover which forms part of the engine body.

Since the injector housing is formed integrally with the head cover, there is no necessity to dispose a member which composes the injector housing around the cylinder head. Consequently, the number of parts can be reduced, and the scale of the engine and complication of the structure around the engine can be minimized.

According to a second aspect of the invention, at least part of a fuel supply passage and compressed air supply passages for supplying fuel and compressed air to the injector housing, respectively, is provided directly in the head cover. With such a configuration as just described, there is no necessity to dispose ducts or the like for supplying fuel and compressed air to the injector housing around the injector housing. Thus, the number of parts can be reduced and the scale of the engine and complication of the structure around the engine can be minimized.

According to a third aspect of the invention, the air fuel injection engine includes intake valves and an exhaust valve disposed on a cylinder head which forms part of the engine body, and a camshaft disposed at a position away from the cylinder head and the head cover, the camshaft forming part of a valve system which drives the intake valves and exhaust valve, and the engine being a four-cycle engine. With such a configuration as just described, the camshaft is not disposed between the cylinder head and the head cover, and the degree of freedom in layout of the injector housing can be increased thereby. Further, where at least part of the fuel supply passage and the compressed air supply passage is provided directly in the head cover, the degree of freedom in layout of the fuel supply passage and the compressed air supply passage can be increased.

Further, according to a fourth aspect of the invention, the injector of the air fuel injection engine is disposed on a cylinder axial line, and on a projection view to a plane perpendicular to the cylinder axial line. A first intake valve port which can be closed up by the first intake valve, and an exhaust valve port which can be closed up by the exhaust valve, are disposed on the opposite sides on the injector, while a second intake valve port which can be closed up by the second intake valve is disposed on one side of the injector on a straight line substantially perpendicular to a straight line interconnecting the first intake valve port and the exhaust valve port.

With this configuration, since the injector is disposed at the central portion of the combustion chamber, one-sidedness of the flame propagation distance in the combustion chamber can be eliminated thereby enhancing the combustion efficiency. Further, since the first and second intake valve ports are provided, improvement of the air filling efficiency and reduction of the pumping loss can be achieved. Furthermore, the ignition plug can be disposed while interference thereof with the two intake valves and the one exhaust valve is prevented readily. This makes it possible to dispose the ignition plug in the proximity of the injector to raise the combustion efficiency.

According to a fifth aspect of the invention, the injector is supported on a head cover, and at least part of a compressed air supply passage for supplying compressed air to the injector is provided directly in the head cover.

With such a configuration, since at least part of the compressed air supply passage is provided directly in the head cover, a part for introducing compressed air to the injector need not be disposed around the head cover, and the scale of the engine and complication of the structure around the engine can be minimized.

According to a sixth aspect of the invention, a cylindrical knock pin is inserted at the opposite end portions thereof in a cylinder head, which cooperates with the head cover to support the injector, and the head cover in such a manner as to extend across mating surfaces of the cylinder head and the head cover. Further, passages are provided directly in the cylinder head and head cover, respectively, the passages forming at least part of the compressed air supply passage are communicated with each other through the knock pin.

With this configuration, since at least part of the compressed air supply passage is provided directly also in the cylinder head, a part for introducing compressed air to the injector need not be disposed around the cylinder head, and thus the scale of the engine and complication of the structure around the engine can be minimized. Further, since the relative positions of the cylinder head and the head cover are defined by the knock pin, even if the injector is supported cooperatively by the head cover and the cylinder head, excessively high stress does not act upon the injector. Furthermore, since the knock pin is used as a connection member for the passage of the cylinder head and the passage of the head cover, the necessity for a part for exclusive use as a passage connection is eliminated, thus further contributing to a reduction of the number of parts.

Further, according to a seventh aspect of the invention, an orifice is formed in the knock pin. With such a configuration as just described, it is possible to adjust the pressure of compressed air to be supplied to the injector. Further, the necessity for a part for exclusive use for such pressure adjustment is eliminated, which can contribute to reduction of the number of parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
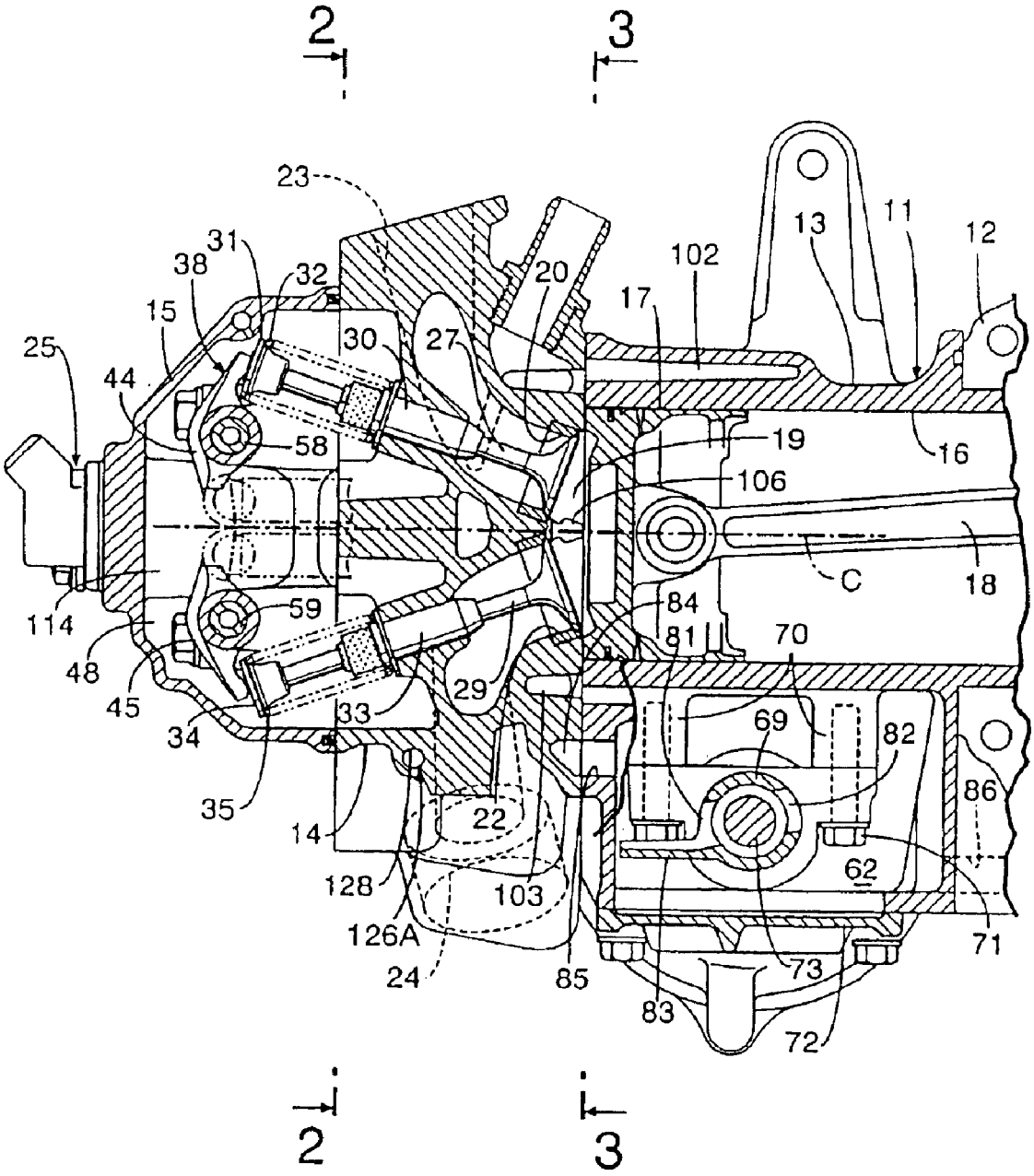
FIG. 1 is a partial vertical sectional view of an air fuel injection four-cycle engine of a first working example and is a sectional view taken along line 1—1 of FIG. 2.

Referring first to FIG. 1, an engine body 11 of the air fuel injection four-cycle engine includes a crankcase 12, a cylinder block 13 coupled to the crankcase 12, a cylinder head 14 coupled to the cylinder block 13 on the opposite side to the crankcase 12, and a head cover 15 coupled to the cylinder head 14 on the opposite side to the cylinder block 13.

A piston 17 is fitted for sliding movement in a cylinder bore 16 provided in the cylinder block 13 and is connected to a crankshaft (not shown) supported for rotation on the crankcase 12 through a connecting rod 18 and a crank pin (not shown). A combustion chamber 19 is formed between the cylinder block 13 and the cylinder head 14 and opposes to a top portion of the piston 17.

Figure 2:
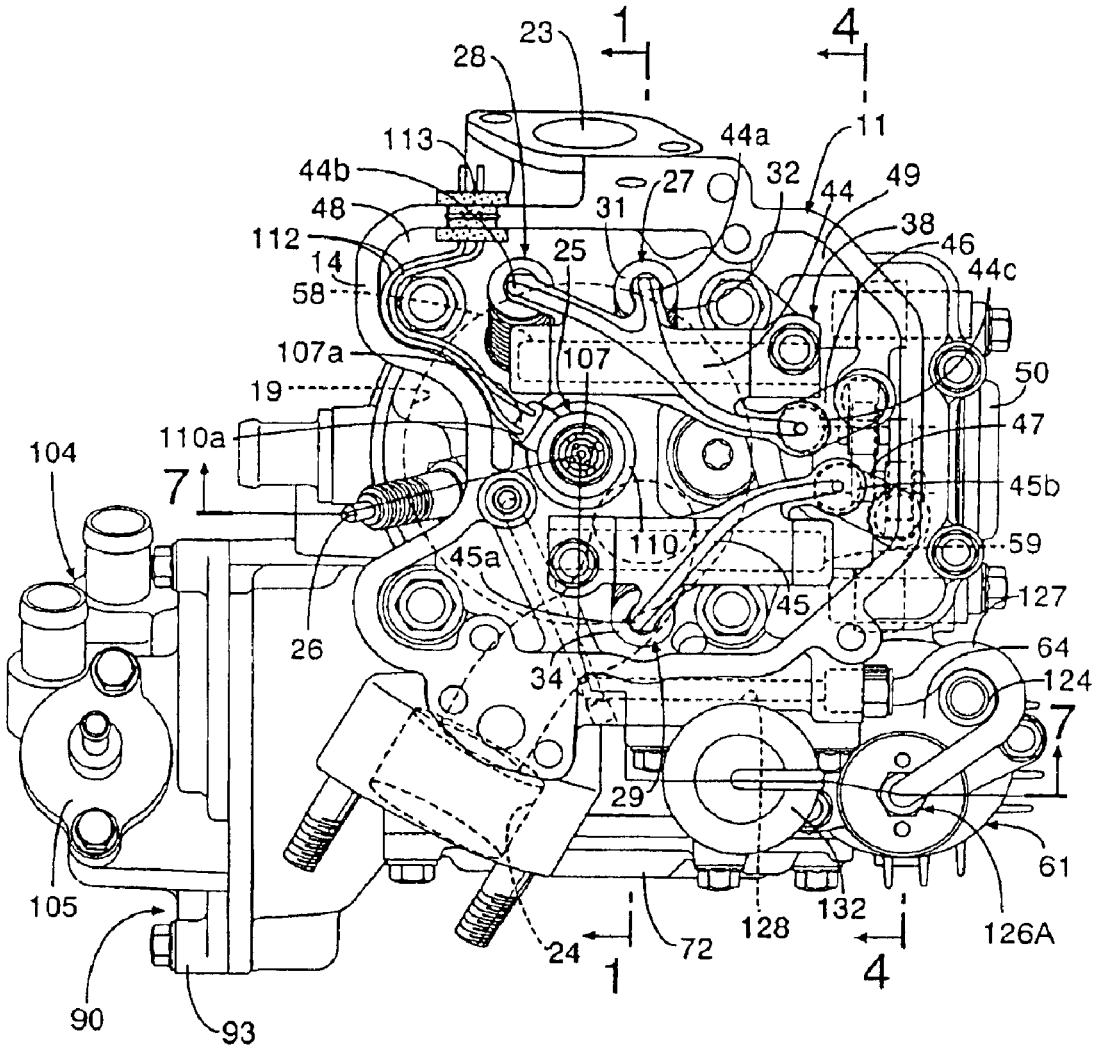
FIG. 2 is a view taken along line 2—2 of FIG. 1 with a head cover removed.
Figure 3:
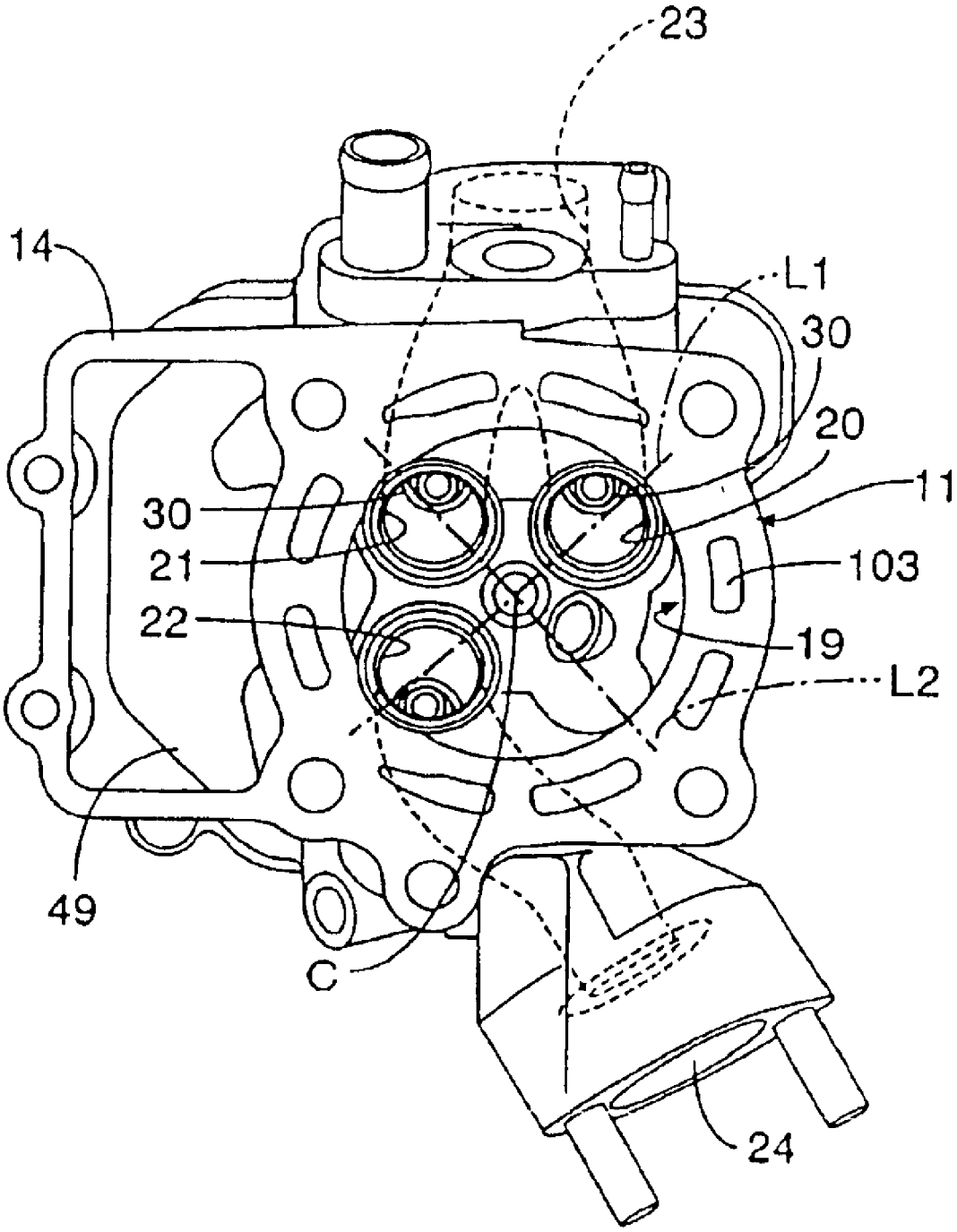
FIG. 3 is a view of a cylinder head as viewed in the direction of an arrow mark along line 3—3 of FIG. 1.

Referring also to FIGS. 2 and 3, provided in the cylinder head 14 are first and second intake valve ports 20 and 21 open to a ceiling face of the combustion chamber 19, and an intake port 23 connected commonly to the first and second intake valve ports 20 and 21 and open to one side face of the cylinder head 14. Also shown are a single exhaust valve port 22 open to the ceiling face of the combustion chamber 19, and an exhaust port 24 connecting to the exhaust valve port 22 and open to the other side face of the cylinder head 14. Further, an injector 25 for directly injecting fuel into the combustion chamber 19 together with compressed air is mounted on the cylinder head 14 such that it is disposed on an axial line of the cylinder bore 16, that is, a cylinder axial line C.

The first intake valve port 20 and the exhaust valve port 22 are disposed on the opposite sides of the cylinder axial line C of the injector 25, on a projection view to a plane perpendicular to the cylinder axial line C, and the second intake valve port 21 is disposed on one side of the cylinder axial line C, on a straight line L2 substantially perpendicular to a straight line L1 interconnecting the first intake valve port 20 and the exhaust valve port 22. Further, an ignition plug 26 is mounted on the cylinder head 14 such that it is opposed to the combustion chamber 19 at a position other than the first intake valve port 20, second intake valve port 21 and exhaust valve port 22.

On the cylinder head 14, first and second intake valves 27 and 28 which open and close the first and second intake valve ports 20 and 21, respectively, are disposed for opening and closing motion, and an exhaust valve 29 which opens and close the exhaust valve port 22 is disposed for opening and closing motion. The first and second intake valves 27 and 28 are fitted for sliding motion in guide tubes 30 fixedly mounted on the cylinder head 14. Valve springs 32 are provided between the cylinder head 14 and retainers 31 individually secured to upper end portions of the two intake valves 27 and 28 projecting from the guide tubes 30 such that the intake valves 27 and 28 are biased in a valve closing direction by spring force exerted by the valve springs 32. The exhaust valve 29 is fitted for sliding motion in a guide tube 33 fixedly mounted on the cylinder head 14. A valve spring 35 is provided between the cylinder head 14 and a retainer 34 secured to an upper end portion of the exhaust valve 29 projecting from the guide tube 33 such that the exhaust valve 29 is biased in a valve closing direction by spring force exerted by the valve spring 35.

Figure 4:
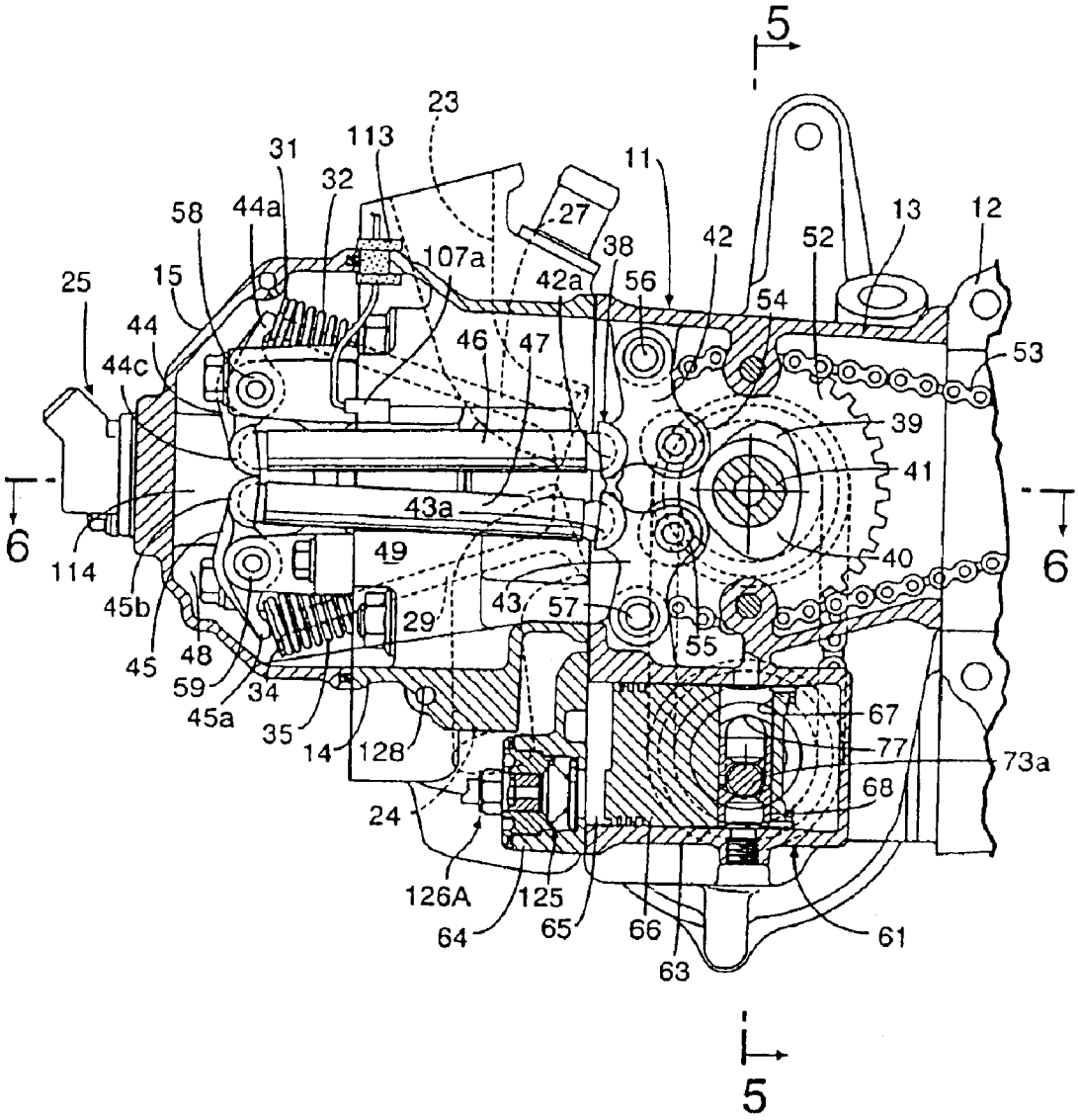
FIG. 4 is a sectional view taken along line 4—4 of FIG. 2.
Figure 5:
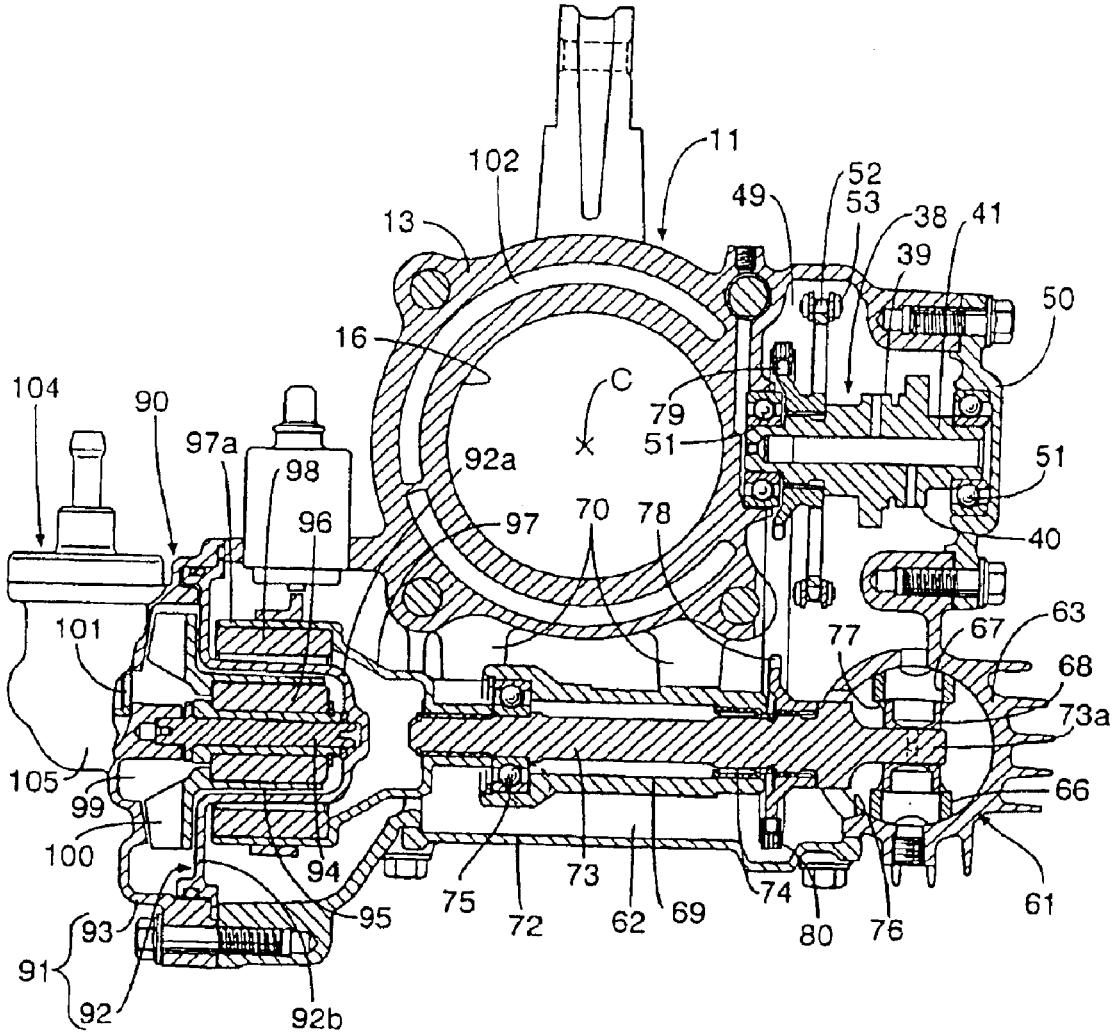
FIG. 5 is a sectional view taken along line 5—5 of FIG. 4.
Figure 6:
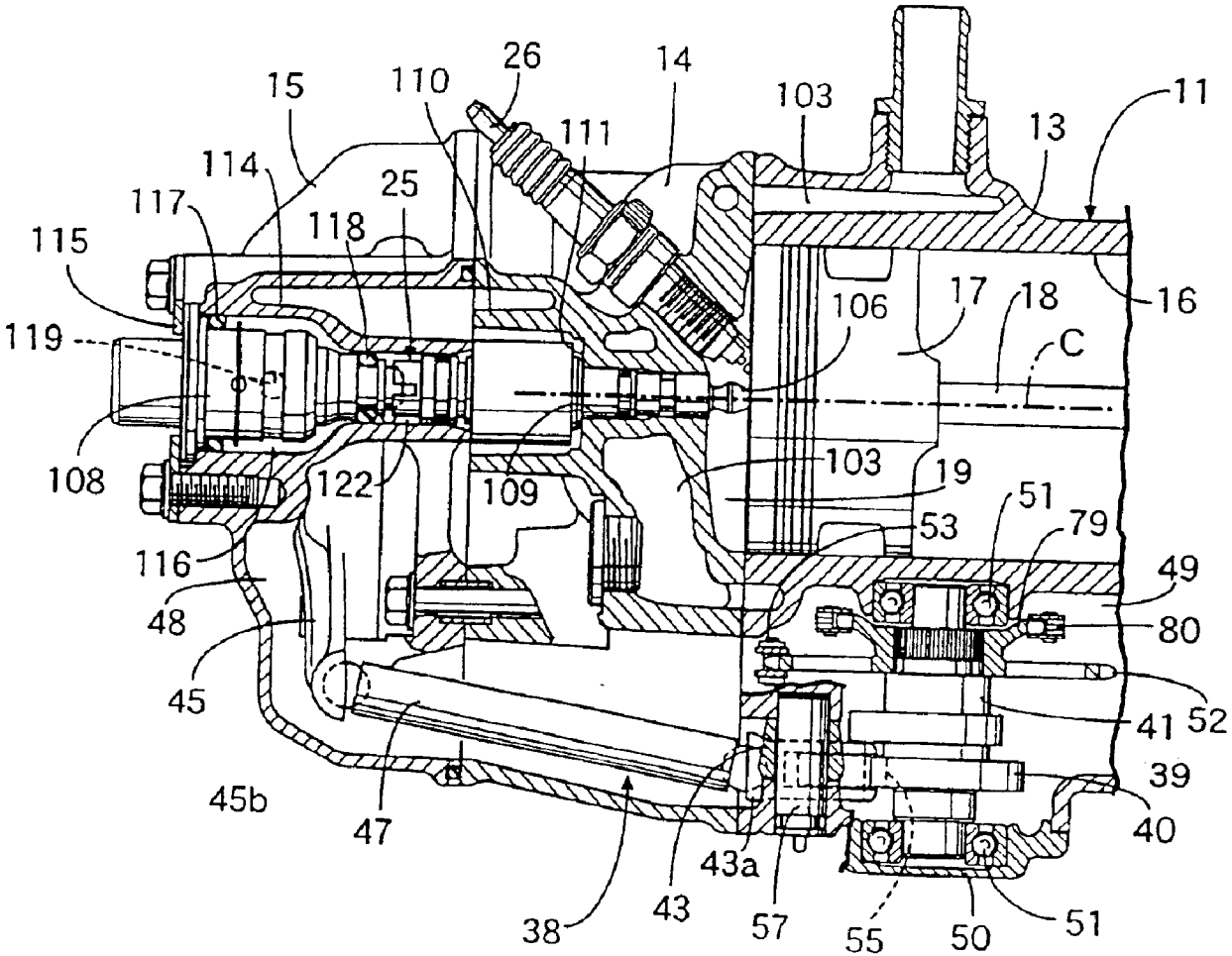
FIG. 6 is a sectional view taken along line 6—6 of FIG. 4.

Referring further additionally to FIGS. 4 to 6, the first and second intake valves 27 and 28 and the exhaust valve 29 are driven to open and close by a valve system 38. The valve system 38 includes a rotatable camshaft 41 having intake side and exhaust side cams 39 and 40, an intake side first rocker arm 42 driven to rock by the intake side cam 39, an exhaust side first rocker arm 43 driven to rock by the exhaust side cam 40, and an intake side second rocker arm 44 having a pair of pressing arm portions 44*a* and 44*b* for contacting with upper ends of the first and second intake valves 27 and 28. The valve system 38 also includes an exhaust side second rocker arm 45 having a pressing arm portion 45*a* for contacting with an upper end of the exhaust valve 29, an intake side push rod 46 provided between the intake side first and second rocker arms 42 and 44 for transmitting the rocking motion of the intake side first rocker arm 42 to the intake side second rocker arm 44, and an exhaust side push rod 47 provided between the exhaust side first and second rocker arms 43 and 45 for transmitting the rocking motion of the exhaust side first rocker arm 43 to the exhaust side second rocker arm 45.

Incidentally, a first valve chamber 48 which accommodates the intake side and exhaust side second rocker arms 44 and 45 and upper portions of the intake side and exhaust side push rods 46 and 47 of the valve system 38 is formed between the cylinder head 14 and the head cover 15. A second valve chamber 49 contiguous to the first valve chamber 48 is formed in the crankcase 12, cylinder block 13 and cylinder head 14 such that it extends in parallel to the cylinder axial line C sidewardly of the cylinder bore 16.

The camshaft 41 of the valve system 38 is accommodated and disposed at a position clear of the first valve chamber 48 between the cylinder head 14 and the head cover 15 in the second valve chamber 49. The camshaft 41 has an axial line parallel to the crankshaft and is supported at the opposite end portions thereof for rotation by the cylinder block 13 and a cover 50, which is fastened to the cylinder block 13 such that it forms an outer side face of the second valve chamber 49, through ball bearings 51, 51.

A first driven sprocket wheel 52 is coupled for no relative rotation to the camshaft 41, and a cam chain 53 for transmitting rotational power from the crankshaft to the camshaft 41 at a speed reduced to ½ is wrapped around the first driven sprocket wheel 52.

The intake side and exhaust side first rocker arms 42 and 43 have rollers 54 and 55 which rolling-contact with the intake side and exhaust side cams 39 and 40 from above, respectively, and are supported for rocking motion by intake side and exhaust side first rocker shafts 56 and 57 provided between the cylinder block 13 and the cover 50 and having axial lines parallel to the camshaft 41. Cup-shaped pressing portions 42*a* and 43*a* are provided integrally on the intake side and exhaust side first rocker arms 42 and 43 such that they are opened upwardly and are positioned above the rollers 54 and 55.

Meanwhile, intake side and exhaust side second rocker shafts 58 and 59 having axial lines parallel to the camshaft 41 are supported on the cylinder head 14 in the first valve chamber 48 such that they are disposed on the opposite sides of the injector 25. The intake side first rocker arm 42 has a pair of pressing arm portions 42*a* and 42*b* branched in a fork shape is supported for rocking motion by the intake side second rocker shaft 58 while the exhaust side first rocker arm 43 is supported for rocking motion by the exhaust side second rocker shaft 59.

Further, a cup-shaped pressure receiving portion 44*c* open downwardly is provided integrally with the intake side second rocker arm 44 on the opposite side to the two pressing arm portions 44*a* and 44*b* with respect to the intake side second rocker shaft 58. Another cup-shaped pressure receiving portion 45*b* open downwardly is provided integrally with the exhaust side second rocker arm 45 on the opposite side to the pressing arm portion 45*a* with respect to the exhaust side second rocker shaft 59.

The intake side and exhaust side push rods 46 and 47 extend upwardly and downwardly between the second valve chamber 49 and the first valve chamber 48, and spherical end portions at lower end portions of the intake side and exhaust side push rods 46 and 47 are fitted for swinging motion with the pressing portions 42*a* and 43*a* of the intake side and exhaust side first rocker arms 42 and 43. The spherical end portions at upper end portions of the intake side and exhaust side push rods 46 and 47 are fitted for swinging motion with the pressure receiving portions 44*c* and 45*b* of the intake side and exhaust side second rocker arms 44 and 45.

With the valve system 38 having the configuration described above, since the intake side first rocker arm 42 is rocked upwardly and downwardly by the intake side cam 39 in response to rotation of the camshaft 41, to which the power of rotation is transmitted at the reduction gear ratio of ½ from the crankshaft, the intake side push rod 46 is operated upwardly and downwardly. In response to the upward and downward motion of the intake side push rod 46, the intake side second rocker arm 44 is rocked to drive the first and second intake valves 27 and 28 to open and close. Meanwhile, the exhaust side first rocker arm 43 is rocked upwardly and downwardly by the exhaust side cam 40 to operate the exhaust side push rod 47 upwardly and downwardly, and in response to the upward and downward motion of the exhaust side push rod 47, the exhaust side second rocker arm 45 is rocked to drive the exhaust valve 29 to open and close.

Incidentally, compressed air is supplied from a compression air pump 61 into the injector 25. The compression air pump 61 is disposed on a side portion of the cylinder block 13 on the side corresponding to the exhaust port 24 provided in the cylinder head 14. An operation chamber 62 is formed in the cylinder block 13 such that it is disposed sidewardly of the cylinder bore 16 in such a manner that it connects in a substantially L-shape to the second valve chamber 49 in a plane perpendicular to the cylinder axial line C. The compression air pump 61 is disposed at the connecting location of the second valve chamber 49 and the operation chamber 62.

Figure 7:
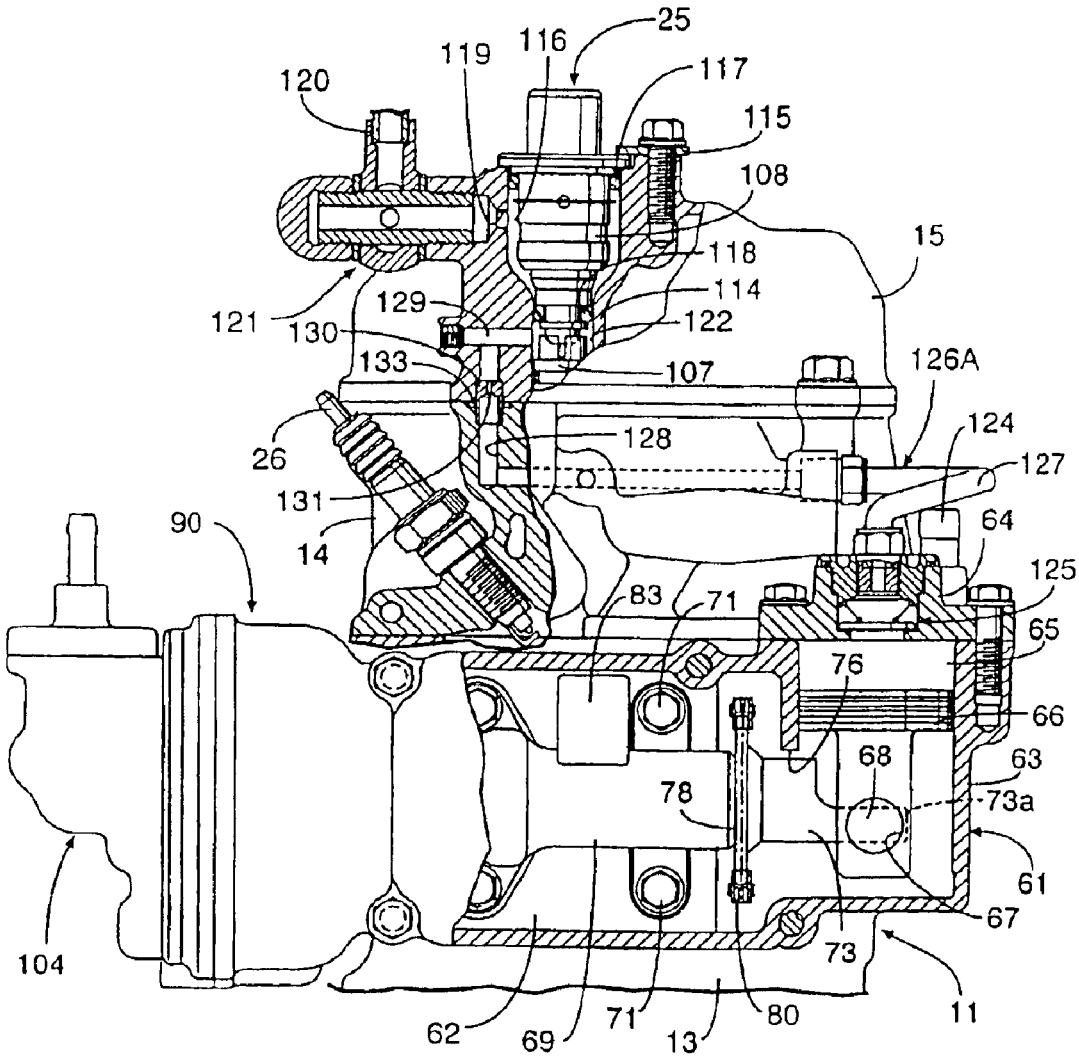
FIG. 7 is a vertical sectional side elevational view of the engine taken along line 7—7 of FIG. 2.

Referring also to FIG. 7, a pump case 63 of the compression air pump 61 is formed integrally with the cylinder block 13 as a bottomed cylinder which has an axial line parallel to the cylinder axial line C and is open to the cylinder head 14 side. A lid member 64 for closing up the opening of the pump case 63 on the cylinder head 14 side airtight is fastened to the cylinder block 13. A piston 66 is fitted for sliding movement in the pump case 63 and cooperates with the lid member 64 to form a pump chamber 65.

A sliding hole 67 is provided in the piston 66 such that it has an axial line which extends along a diametrical line of the piston 66 and passes the axial line of the camshaft 41, and a sliding piece 68 is fitted for sliding movement in the sliding hole 67. Meanwhile, a cylindrical bearing member 69 is disposed in the operation chamber 62 such that it has an axial line which extends in parallel to the axial line of the camshaft 41 and passes the axial line of the piston 66. The bearing member 69 is fastened to a plurality of, for example, four, fastening bosses 70 provided in a projecting manner on the cylinder block 13 by means of bolts 71. A cover 72 is fastened to the cylinder block 13 and forms an outer side face of the operation chamber 62 such that tightening and loosening operations for the bolts 71 can be performed when the cover 72 is open.

A rotary shaft 73 is fitted coaxially in the bearing member 69, and a roller bearing 74 is interposed between one end portion of the bearing member 69 and the rotary shaft 73 while a ball bearing 75 is interposed between the other end portion of the bearing member 69 and the rotary shaft 73. In other words, the rotary shaft 73 is supported for rotation by the bearing member 69 fastened to the cylinder block 13.

At one end of the rotary shaft 73 which projects from the one end portion of the bearing member 69, an eccentric shaft 73*a* is provided integrally such that it projects from an eccentric position of the rotary shaft 73. The eccentric shaft 73*a* is connected at an end thereof to the sliding piece 68. Consequently, in response to rotation of the rotary shaft 73, the eccentric shaft 73*a* is revolved around the axial line of the rotary shaft 73, whereupon the piston 66 is slidably moved within the pump case 63 such that it increases and decreases the volume of the pump chamber 65.

An opening 76 for allowing one end portion of the rotary shaft 73 to be inserted therein is provided in the pump case 63, and an insertion hole 77 is provided in the piston 66 in a communicating relationship with a central portion of the sliding hole 67 in its longitudinal direction and allows the eccentric shaft 73*a* to be inserted therein such that it permits the eccentric shaft 73*a* to move in directions along the axial line of the sliding hole 67 in response to rotation of the rotary shaft 73.

Incidentally, a second driven sprocket wheel 78 is secured to an end portion of the rotary shaft 73 between the pump case 63 and the bearing member 69, and an endless chain 80 extends between and around a driving sprocket wheel 79 formed integrally with the first driven sprocket wheel 52 around which the cam chain 53 is wrapped and the second driven sprocket wheel 78. Consequently, the rotary shaft 73, that is, the compression air pump 61, is rotated by the power transmitted thereto from the camshaft 41.

Perforations 81 and 82 are provided on the opposite side portions of the bearing member 69 at a central location between the ball bearing 75 and the roller bearing 74. An oil guide 83 for introducing part of oil dropping into the operation chamber 62 to the location between the bearing member 69 and the rotary shaft 73 is provided integrally with the bearing member 69 at a position corresponding to the perforation 81. In particular, an oil returning passage 84 is provided in the cylinder head 14 such that it introduces oil from the first valve chamber 48, and an oil returning passage 85 is provided in the cylinder block 13 and opens to the operation chamber 62 through the oil returning passage 84. The oil guide 83 is provided integrally with the bearing member 69 such that it introduces oil dropping from another oil returning passage 85 to the perforation 81.

Further, part of oil introduced to the location between the bearing member 69 and the rotary shaft 73 is used for lubrication of the roller bearing 74 and the ball bearing 75 while the other part drops from the perforation 82 to a lower portion in the operation chamber 62. Oil accumulated at the lower portion of the operation chamber 62 is returned to the crankcase 12 side through a further oil returning passage 86 provided in the cylinder block 13 such that it is communicated with the lower portion of the operation chamber 62.

A water pump 90 is mounted on the cylinder block 13 on the opposite side to the compression air pump 61 with respect to the bearing member 69 such that it has an axial line of rotation coaxial with the rotary shaft 73. A pump housing 91 of the water pump 90 is formed from a housing main member 92 which includes a bottomed cylindrical portion 92*a* closed on the rotary shaft 73 side thereof and a dish-like portion 92*b* provided integrally with an open end of the bottomed cylindrical portion 92*a*, and a pump cover 93 which closes up the open end of the housing main member 92. The pump cover 93 is fastened to the cylinder block 13 such that it cooperates with the cylinder block 13 to hold an outer periphery of the open end of the housing main member 92 therebetween.

A pump shaft 94 is supported at the opposite end portions thereof for rotation at a central portion of the closed end of the bottomed cylindrical portion 92*a* and a central portion of the pump cover 93 coaxially with the rotary shaft 73, and a plurality of magnets 96 are securely mounted on a rotor 95 which is inserted in the bottomed cylindrical portion 92*a* such that it rotates integrally with the pump shaft 94. Meanwhile, a rotary member 97 is secured to the other end portion of the rotary shaft 73 which projects from the other end of the bearing member 69, and has a cylindrical portion 97*a* which coaxially surrounds the bottomed cylindrical portion 92*a* of the housing main member 92. A plurality of magnets 98 are securely mounted on an inner face of the cylindrical portion 97*a*. Consequently, when the rotary member 97 rotates together with the rotary shaft 73, the rotor 95 rotates together with the pump shaft 94.

Incidentally, a whirl chamber 99 is formed between the housing main member 92 and the pump cover 93, and an impeller 100 is provided for the rotor 95 and accommodated in the whirl chamber 99.

A plurality of admission ports 101 are provided in the pump cover 93 and open to a central portion of the whirl chamber 99, and cooling water sucked into the whirl chamber 99 through the admission ports 101 is pressurized by rotation of the impeller 100. Thus, the cooling water discharged from the water pump 90 is supplied to a block side water jacket 102 provided for the cylinder block 13 and is supplied to a head side water jacket 103 provided for the cylinder head 14 through the block side water jacket 102, and a state wherein the cooling water discharged from the head side water jacket 103 is introduced into a radiator and so forth not shown and another state wherein the cooling water discharged from the head side water jacket 103 is returned to the admission ports 101 bypassing the radiator and so forth are changed over by a thermostat 104. A thermostat housing 105 of the thermostat 104 is formed integrally with the pump cover 93 of the water pump 90.

Referring particularly to FIG. 6, the injector 25 includes an air fuel injection valve 107 mounted on the cylinder head 14 and having a nozzle 106 projecting into the combustion chamber 19, and a fuel injection valve 108 connected to the air fuel injection valve 107 in such a manner as to inject fuel from rearwardly into the air fuel injection valve 107. The air fuel injection valve 107 directly injects fuel into the combustion chamber 19 together with compressed air.

A fitting hole 109 in which the nozzle 106 is to be fitted airtight and an insertion tube 110 having an inner diameter greater than the fitting hole 109 and coaxially connecting to the fitting hole 109 are provided coaxially with the cylinder axial line C in the cylinder head 14. The air fuel injection valve 107 is fitted at the nozzle 106 thereof airtight in the fitting hole 109 and is inserted into the insertion tube 110 until it is brought into contact with an annular stepped portion 111 formed between the fitting hole 109 and the insertion tube 110.

A lead connecting portion 107*a* is provided at a rear portion of the air fuel injection valve 107 and disposed in a recess 110*a* provided at a rear end of the insertion tube 110, and a pair of leads 112 are led out from the lead connecting portion 107*a* outside the insertion tube 110 to the outside through a grommet 113 held between mating surfaces of the cylinder head 14 and the head cover 15.

Meanwhile, a cylindrical injector housing 114 is formed integrally on the head cover 15 such that it holds the fuel injection valve 108 fitted therein and cooperates with the cylinder head 14 to hold the air fuel injection valve 107 therebetween. When the head cover 15 is coupled to the cylinder head 14, an end portion of the injector housing 114 contacts with a rear end of the air fuel injection valve 107. A clamping plate 115 is fastened to a rear end of the injector housing 114 and cooperates with the injector housing 114 to hold a rear end portion of the fuel injection valve 108 therebetween.

Incidentally, an annular fuel chamber 116 is formed between the injector housing 114 and the fuel injection valve 108 such that it communicates with the inside of the fuel injection valve 108. A pair of seal members 117 and 118 are interposed between the fuel injection valve 108 and the injector housing 114 and cooperatively hold the fuel chamber 116 from the opposite sides therebetween.

A fuel supply passage 119 is provided directly in the head cover 15 such that it communicates with the fuel chamber 116, and a hose 120 for introducing fuel from a fuel supply source not shown is connected to the fuel supply passage 119 through a coupling 121.

An annular air chamber 122 is formed between an end portion of the fuel injection valve 108 and rear end portion of the air fuel injection valve 107 and the injector housing 114 such that it communicates with the inside of the air fuel injection valve 107. Compressed air from the compression air pump 61 is supplied into the air chamber 122.

Referring particularly to FIGS. 2 and 7, a suction pipe 124 is provided in the lid member 64 of the compression air pump 61, and a hose for introducing air from an air cleaner (not shown) is connected to the suction pipe 124. The suction pipe 124 is connected to the pump chamber 65 through a reed valve (not shown) built in the lid member 64.

A reed valve 125 is built in the lid member 64 and opened in response to an increase of the pressure of the pump chamber 65. Compressed air discharged from the compression air pump 61 is supplied into the air chamber 122 through the reed valve 125 and a compressed air supply passage 126A.

The compressed air supply passage 126A includes a pipe member 127 connected at an end thereof to the lid member 64 in a communicating relationship with the reed valve 125 and connected at the other end thereof to the cylinder head 14, a passage 128 provided directly in the cylinder head 14 in a communicating relationship with the pipe member 127, and another passage 129 provided directly in the head cover 15 in a communicating relationship with the passage 128 and also with the air chamber 122.

Also, part of the passage 128 provided directly in the cylinder head 14 passes in the proximity of the exhaust port 24, and particularly in the proximity of the exhaust port 24, the head side water jacket 103 is disposed between the exhaust port 24 and the cylinder block 13 while the passage 128 is set so as to pass the opposite side to the head side water jacket 103 with respect to the exhaust port 24.

A cylindrical knock pin 130 extends across mating surfaces of the cylinder head 14 and the head cover 15 and is inserted at the opposite end portions thereof in the cylinder head 14 and the head cover 15 such that the passages 128 and 129 provided directly in the cylinder head 14 and the head cover 15 and forming part of the compressed air supply passage 126A are communicated with each other through the knock pin 130. An O-snap ring 133 is held between the mating surfaces of the cylinder head 14 and the head cover 15 and surrounds the knock pin 130.

An orifice 131 is formed in the knock pin 130, and a relief valve 132 is mounted on the cylinder head 14 and connected to the passage 128 on the upstream side with respect to the orifice 131.

Next, action of a first working example is described. Since at least part of the compressed air supply passage 126A for supplying compressed air to the injector 25, that is, part of the passage 128 provided directly in the cylinder head 14 and forming part of the compressed air passage 126A, passes in the proximity of the exhaust port 24, compressed air circulating along the compressed air supply passage 126A can be warmed with the heat of exhaust gas circulating through the exhaust port 24. This increases the volume of the compressed air, thereby improving the pump efficiency.

In the proximity of the exhaust port 24, part of the head side water jacket 103 is disposed between the exhaust port 24 and the cylinder block 13, and the passage 128 forming part of the compressed air supply passage 126A is disposed on the opposite side to the head side water jacket 103 with respect to the exhaust port 24. Consequently, an influence on compressed air circulating along the compressed air supply passage 126A, caused by cooling by the head side water jacket 103 can be prevented to the utmost and even where the engine is of the water-cooled type, a high pump efficiency can be maintained.

Further, the compression air pump 61 connected to the compressed air supply passage 126A is disposed sidewardly of the cylinder block 13 on the side corresponding to the exhaust port 24, and the compression air pump 61 can be disposed in an arrangement space of the engine including an exhaust pipe connected to the exhaust port 24. In addition, the pump case 63 of the compression air pump 61 is formed integrally with the cylinder block 13. Consequently, it is possible to achieve reduction of the number of parts, and minimize the scale of the engine and complication of the engine structure in the proximity of the compression air pump 61.

Further, while the fuel injection valve 108 of the injector 25 is fitted with and held by the injector housing 114, since the injector housing 114 is formed integrally with the head cover 15, there is no necessity to dispose a member, which composes the injector housing 114, around the cylinder head 14. Consequently, the number of parts can be reduced, and the scale of the engine and complication of the structure around the engine can be minimized.

Further, since the fuel supply passage 119 for supplying fuel and compressed air to the injector housing 114 and the passage 129 which is at least part of the compressed air supply passage 126A are provided directly in the head cover 15, there is no necessity to dispose ducts or the like for supplying fuel and compressed air to the injector housing 114 around the injector housing 114. Also thereby, the number of parts can be reduced, and increase in scale of the engine and complication of the structure around the engine can be prevented.

Incidentally, the camshaft 41, drives the first intake valve 27, second intake valve 28 and exhaust valve 29 disposed on the cylinder head 14, is disposed on the cylinder block 13 side and away from a location between the cylinder head 14 and the head cover 15. Consequently, the camshaft 41 is prevented from being disposed between the cylinder head 14 and the head cover 15. Also, the degree of freedom in layout of the injector housing 114, and the degree of freedom in layout of the fuel supply passage 119 and the passage 129 provided directly in the head cover 15 are both increased.

Furthermore, the injector 25 is disposed on the cylinder axial line C, and on a projection view to a plane perpendicular to the cylinder axial line C, the first intake valve port 20 and the exhaust valve port 22 are disposed on the opposite sides of the injector 25 and the second intake valve port 21 is disposed on one side of the injector 25 on a straight line L2 substantially perpendicular to a straight line L1 interconnecting the first intake valve port 20 and the exhaust valve port 22. Consequently, by disposing the injector 25 at a central portion of the combustion chamber 19, one-sidedness to the flame propagation distance in the combustion chamber 19 can be eliminated, thus raising the combustion efficiency. Further, by providing both the first and second intake valve ports 20 and 21, air-filling efficiency is improved and reduction of the pumping loss can be achieved. The ignition plug 26 can be disposed such that interference thereof with the two intake valves 27 and 28 and the one exhaust valve 29 is prevented readily, and the ignition plug 26 can be arranged in the proximity of the injector 25, allowing for improved combustion efficiency.

Further, the air fuel injection valve 107 of the injector 25 is supported on the head cover 15, and the passage 129 which is at least part of the compressed air supply passage 126A for supplying compressed air to the air fuel injection valve 107 is provided directly in the head cover 15. Consequently, a part for introducing compressed air to the injector 25 is need not be disposed around the head cover 15, thus minimizing the scale of the engine and complication of the structure around the engine.

Further, the cylindrical knock pin 130 extends across the mating surfaces of the cylinder head 14 and the head cover 15. Opposite end portions of the knock pin 130 are in the cylinder head 14 and the head cover 15. This allows passages 128 and 129, which are provided directly in the cylinder head 14 and the head cover 15 and forming at least part of the compressed air supply passage 126A, to communicate with each other through the knock pin 130. Consequently, even if the relative positions of the cylinder head 14 and the head cover 15 are defined by the knock pin 130 and the injector 25 is supported cooperatively by the head cover 15 and the cylinder head 14, excessively high stress does not act upon the injector 25. Furthermore, since the knock pin 130 is used as a connection member for the passage 128 of the cylinder head 14 and the passage 129 of the head cover 15, the necessity for a part for exclusive use for passage connection is eliminated, thus reducing of the number of parts required.

Furthermore, since the orifice 131 is formed in the knock pin 130, it is possible to adjust the pressure of compressed air to be supplied to the injector 25, and the necessity for a part for exclusive use for such pressure adjustment is eliminated, again reducing the number of parts.

Figure 8:
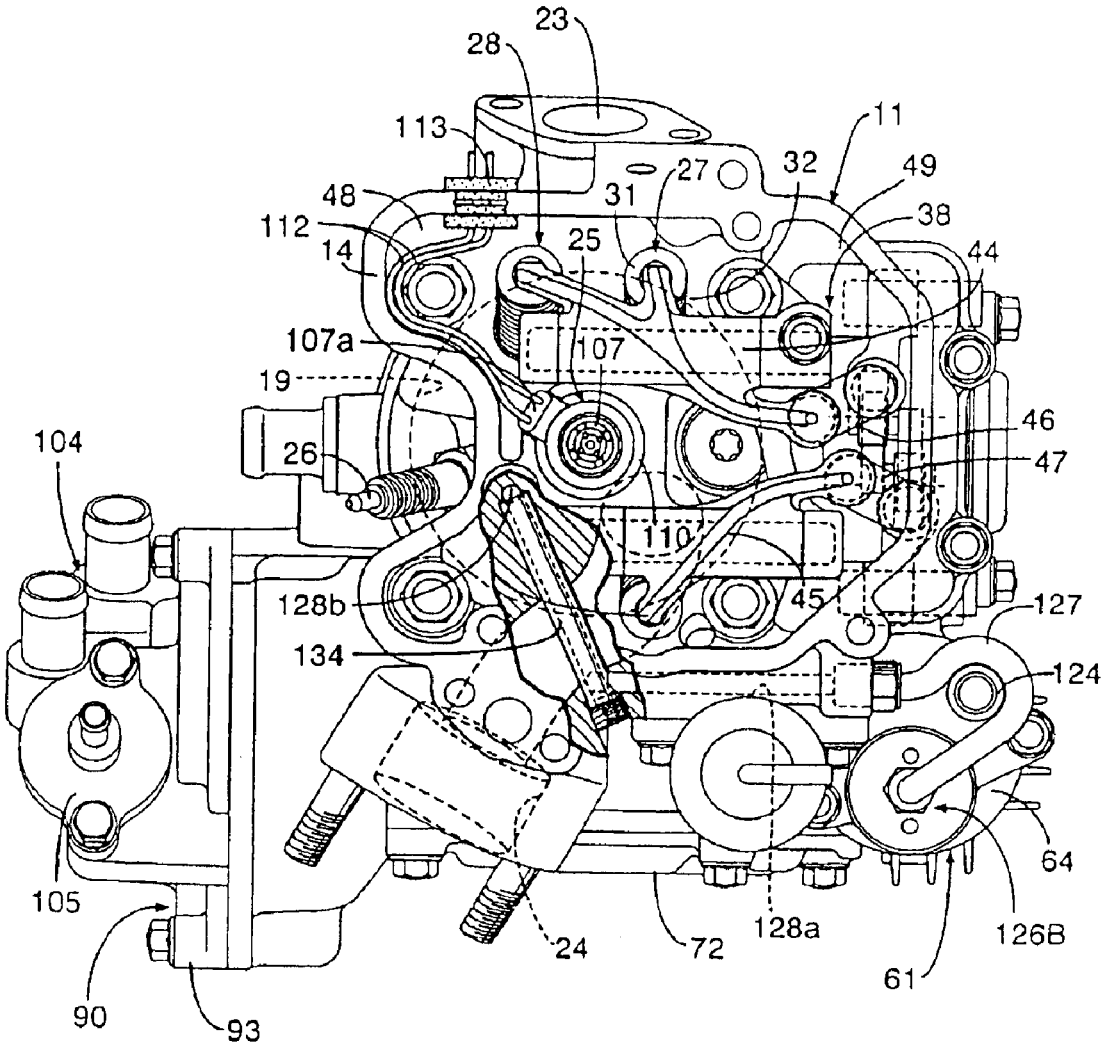
FIG. 8 is a partly broken view of a second working example corresponding to FIG. 2.

FIG. 8 shows a second working example of the present invention, and elements corresponding to those of the first working example described above are denoted by like reference characters.

A compressed air supply passage 126B for supplying compressed air to an injector 25 includes a pipe member 127 connected at an end thereof to a lid member 64 in a communicating relationship with the reed valve 125, a passage 128*a* provided directly in the cylinder head 14 in a communicating relationship with the pipe member 127, and a regulator 134 in the form of a pipe mounted on the cylinder head 14 such that it extends through an exhaust port 24 and communicating with the passage 128*a*. Also, a passage 128*b* is provided directly in the cylinder head 14 in a communicating relationship with the regulator 134, and a passage 129 (refer to the first working example) is provided directly in the head cover 15 in a communicating relationship with the passage 128*b*.

Also with this second working example, compressed air circulating along the compressed air supply passage 126B can be warmed with the heat of exhaust gas circulating through the exhaust port 24 to increase the volume of the compressed air thereby to improve the pump efficiency. Further, a part for introducing compressed air to the injector 25 need not be disposed around the cylinder head 14 and the head cover 15, thus minimizing the scale of the engine and complication of the structure around the engine.

While preferred working examples of the present invention have been described, the present invention is not limited to the working examples described above, but various design changes can be performed without departing from the present invention as defined in the claims.

Next, the effects of the present invention will be described.

As described above, according to the first aspect of the invention, since the injector housing is formed integrally with the head cover, there is no necessity to dispose a member which composes the injector housing around the cylinder head. Consequently, the number of parts can be reduced, and the scale of the engine and complication of the structure around the engine can be minimized.

Further, according to the second aspect of the invention, there is no need for disposing ducts or the like for supplying fuel and compressed air to the injector housing around the injector housing. Accordingly, the number of parts can be reduced and the scale of the engine and complication of the structure around the engine can be kept to a minimum.

According to the third aspect of the invention, the camshaft is not disposed between the cylinder head and the head cover, and the degree of freedom in layout of the injector housing can be increased thereby. Further, since at least part of the fuel supply passage and the compressed air supply passage is provided directly in the head cover, the degree of freedom in layout of the fuel supply passage and the compressed air supply passage can be increased.

Furthermore, according to the fourth aspect of the invention, since the injector is disposed at the central portion of the combustion chamber, one-sidedness of the flame propagation distance in the combustion chamber can be eliminated thereby to enhance the combustion efficiency. Further, since the first and second intake valve ports are provided, improvement of the air filling efficiency and reduction of the pumping loss can be achieved. Furthermore, the ignition plug can be disposed while interference thereof with the two intake valves and the one exhaust valve is readily prevented. This makes it possible to dispose the ignition plug in the proximity of the injector to raise the combustion efficiency.

According to the fifth aspect of the invention, a part for introducing compressed air to the injector need not be disposed around the head cover.

Further, according to the sixth aspect of the invention, a part for introducing compressed air to the injector need not be disposed around the cylinder head, thus further keeping the scale of the engine and complication of the structure around the engine to a minimum. Further, even if the injector is supported cooperatively by the head cover and the cylinder head, excessively high stress does not act upon the injector. Also, the need for a part for exclusive use for passage connection is eliminated, again contributing to a reduction of the number of parts required.

Furthermore, according to the seventh aspect of the invention, it is possible to adjust the pressure of compressed air to be supplied to the injector, and the need for a part for exclusive use for such pressure adjustment is eliminated, again contributing to a reduction of the number of parts required.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air fuel injection engine, comprising:

an injector having a fuel injection valve for injecting fuel and an air fuel injection valve for directly injecting fuel together with compressed air into a combustion chamber; and an injector housing for holding and securing said injector to an engine body, wherein said injector housing is formed integrally with a head cover which forms part of said engine body, wherein at least part of compressed air supply passages for supplying compressed air to said injector housing is provided directly in said head cover.

2. The air fuel injection engine according to claim 1, wherein at least part of a fuel supply passage for supplying fuel to said injector housing is provided directly in said head cover.

3. The air fuel injection engine according to claim 1, further comprising:

intake valves and an exhaust valve disposed on a cylinder head which forms part of said engine body; and a camshaft disposed at a position away from said cylinder head and said head cover and forming part of a valve system which drives said intake valves and exhaust valve, and is formed as a four-cycle engine.

4. The air fuel injection engine according to claim 3, wherein said injector is disposed on a cylinder axial line C, and on a projection view to a plane perpendicular to said cylinder axial line C, a first intake valve port which can be closed up by the first intake valve and an exhaust valve port which can be closed up by said exhaust valve are disposed on the opposite sides on said injector while a second intake valve port which can be closed up by the second intake valve is disposed on one side of said injector on a straight line L2 substantially perpendicular to a straight line L1 interconnecting said first intake valve port and said exhaust valve port.

5. The air fuel injection engine according to claim 1, wherein at least part of a compressed air supply passage for supplying compressed air to said injector is provided directly in said head cover.

6. A air fuel injection engine according to claim 1, further comprising:

a cylindrical knock pin inserted at the opposite end portions thereof in a cylinder head, which cooperates with said head cover to support said injector, and said head cover, the knock pin extending across mating surfaces of said cylinder head and said head cover; and passages provided directly in said cylinder head and head cover, respectively, and forming at least part of said compressed air supply passage communicates through said knock pin.

7. The air fuel injection engine according to claim 6, wherein an orifice is formed in said knock pin.

8. The air fuel injection engine according to claim 1, when the head cover is coupled to the cylinder head, an end portion of the injector housing contacts with a rear end of the air fuel injection valve, and a clamping plate is fastened to a rear end of the injector housing and cooperates with the injector housing to hold a rear end portion of the fuel injection valve therebetween.

9. The air fuel injection engine according to claim 8, wherein an annular fuel chamber is formed between the injector housing and the fuel injection valve such that it communicates with the inside of the fuel injection valve.

10. The air fuel injection engine according to claim 4, wherein the camshaft is supported at the opposite end portions thereof for rotation by a cylinder block and a cover, the cover being fastened to the cylinder block such that it forms an outer side face of a second valve chamber.

11. The air fuel injection engine according to claim 6, wherein an O-snap ring is held between the mating surfaces of the cylinder head and the head cover and surrounds the knock pin.

12. The air fuel injection engine according to claim 7, wherein a relief valve is mounted on the cylinder head and connected to one of the passages on the upstream side with respect to the orifice.

13. The fuel air injection engine according to claim 5, wherein the compressed air passage, passes in the proximity of the exhaust port, so that the compressed air circulating along the compressed air supply passage can be warmed with the heat of exhaust gas circulating through an exhaust port.

14. A fuel injection apparatus, comprising:

an injector having a fuel injection valve for injecting fuel and an air fuel injection valve for directly injecting fuel together with compressed air into a combustion chamber; and an injector housing for holding and securing said injector to an engine body; and a clamping plate fastened to a rear end of the injector housing, the clamping plate cooperating with the injector housing to hold a rear end portion of the fuel injection valve therebetween, wherein said injector housing is formed integrally with a head cover which forms part of said engine body, wherein at least part of compressed air supply passages for supplying compressed air to said injector housing is provided directly in said head cover.

15. The fuel injection apparatus according to claim 14, wherein at least part of a fuel supply passage for supplying fuel to said injector housing, is provided directly in said head cover.

16. The fuel injection apparatus according to claim 14, further comprising:

intake valves and an exhaust valve disposed on a cylinder head which forms part of said engine body; and a camshaft disposed at a position away from said cylinder head and said head cover and forming part of a valve system which drives said intake valves and exhaust valve.

17. The fuel injection apparatus according to claim 15, wherein said injector is disposed on a cylinder axial line C, and on a projection view to a plane perpendicular to said cylinder axial line C, a first intake valve port which can be closed up by the first intake valve and an exhaust valve port which can be closed up by said exhaust valve are disposed on the opposite sides on said injector while a second intake valve port which can be closed up by the second intake valve is disposed on one side of said injector on a straight line L2 substantially perpendicular to a straight line L1 interconnecting said first intake valve port and said exhaust valve port.

18. The fuel injection apparatus according to claim 14, wherein at least part of a compressed air supply passage for supplying compressed air to said injector is provided directly in said head cover.

19. The fuel injection apparatus according to claim 14, further comprising:

a cylindrical knock pin inserted at the opposite end portions thereof in a cylinder head, which cooperates with said head cover to support said injector, and said head cover, the knock pin extending across mating surfaces of said cylinder head and said head cover; and passages provided directly in said cylinder head and head cover, respectively, and forming at least part of said compressed air supply passage communicates through said knock pin.

20. An air fuel injection engine, comprising:

an injector having a fuel injection valve for injecting fuel and an air fuel injection valve for directly injecting fuel together with compressed air into a combustion chamber; and an injector housing for holding and securing said injector to an engine body, wherein said injector housing is formed integrally with a head cover which forms part of said engine body, wherein the air fuel engine further comprises:

a cylindrical knock pin inserted at opposite end portions thereof in a cylinder head, which cooperates with said head cover to support said injector, and said head cover, the knock pin extending across mating surfaces of said cylinder head and said head cover; and passages provided directly in said cylinder head and head cover, respectively, and forming at least part of said compressed air supply passage communicates through said knock pin.

* * * * *